US011496849B2

(12) United States Patent
Edgren et al.

(10) Patent No.: US 11,496,849 B2
(45) Date of Patent: Nov. 8, 2022

(54) ACOUSTIC RADIATION REPRODUCTION

(71) Applicant: Zound Industries International AB, Stockholm (SE)

(72) Inventors: Dan Anders Edgren, Värmdö (SE); Malcolm Ian Kennedy, Stockholm (SE)

(73) Assignee: Zound Industries International AB, Stockholm (SE)

( * ) Notice: Subject to any disclaimer, the term of this patent is extended or adjusted under 35 U.S.C. 154(b) by 0 days.

(21) Appl. No.: 17/259,502

(22) PCT Filed: Jul. 13, 2018

(86) PCT No.: PCT/EP2018/069125
§ 371 (c)(1),
(2) Date: Jan. 11, 2021

(87) PCT Pub. No.: WO2020/011372
PCT Pub. Date: Jan. 16, 2020

(65) Prior Publication Data

US 2021/0274300 A1 Sep. 2, 2021

(51) Int. Cl.
*H04R 5/00* (2006.01)
*H04S 1/00* (2006.01)
*H04S 7/00* (2006.01)

(52) U.S. Cl.
CPC ..... *H04S 1/002* (2013.01); *H04S 7/30* (2013.01)

(58) Field of Classification Search
CPC ..... H04S 1/002; H04S 7/30
USPC ..... 381/26
See application file for complete search history.

(56) References Cited

U.S. PATENT DOCUMENTS 5,870,484 A * 2/1999 Greenberger ..... H04S 3/002 381/300

FOREIGN PATENT DOCUMENTS

| | | | | |
|---|---|---|---|---|
| EP | 1475996 | | 11/2004 | |
| EP | 1475996 | A1 * | 11/2004 | ..... H04S 7/30 |
| EP | 1475996 | B1 * | 4/2009 | ..... H04S 7/30 |
| EP | 2875624 | A1 * | 5/2015 | ..... H04M 1/035 |
| EP | 2875624 | B1 * | 9/2018 | ..... H04M 1/035 |
| GB | 394325 | | 6/1933 | |
| GB | 2425675 | | 11/2006 | |
| WO | WO 2009128078 | | 10/2009 | |

OTHER PUBLICATIONS

International Search Report filed in PCT application No. PCT/EP2018/069125, dated Mar. 8, 2009, in 4 pages.

* cited by examiner

*Primary Examiner* — Ammar T Hamid
(74) *Attorney, Agent, or Firm* — Knobbe Martens Olson & Bear, LLP

(57) ABSTRACT

A method of producing an acoustic radiation pattern, the method comprising receiving an input audio signal representing a first acoustic radiation pattern, generating an acoustic monopole and an acoustic dipole based on the input audio signal, wherein generating the acoustic monopole and the acoustic dipole is to produce a second acoustic radiation pattern substantially similar to the first acoustic radiation pattern.

20 Claims, 13 Drawing Sheets

ACOUSTIC RADIATION REPRODUCTION

CROSS REFERENCE TO RELATED APPLICATION

This application is a U.S. National Phase Application of PCT International Application Number PCT/EP2018/069125, filed on Jul. 13, 2018, designating the United States of America and published in the English language. The disclosure of the above-referenced application is hereby expressly incorporated by reference in its entirety.

FIELD

The present application relates to acoustic radiation production. In particular, the application relates to methods and devices for producing an acoustic radiation pattern.

BACKGROUND

In audio playback applications, a piece of audio is played back using a sound producing device. For example, a music recording encoded in an electronic file can be output by a speaker unit of a home entertainment system. Many different configurations of playback systems and speakers exist that aim to provide high quality playback of audio to a listener.

Many sound recording techniques involve capturing an acoustic radiation pattern. This pattern represents the sound field produced by an acoustic source, for example a musical instrument, in both intensity and direction. One way in which an acoustic radiation pattern can be recorded is described in GB394325. The method described is known as "Blumlein recording", after its inventor A. D. Blumlein. This recording can capture a spatial, or "true directional", impression of an acoustic source by using two or more microphones configured to capture the sound field of an acoustic source, including its directional qualities. This is essentially a way to emulate human hearing, where humans detect phase and intensity differences in a sound field as the sound waves arrive at each of our left and right ears. The brain can then use this to determine the direction from which the sound is coming.

The captured audio can be encoded in an electronic signal and the left and right sides of the sound field can be defined. The electrical stereophonic signal encoding proposed by Blumlein is described by the now classic and simple relations:

$$left = mid + side$$

$$right = mid - side$$

In these relations, the "mid" signal represents the centre of a stereo image and the "side" signal represents the edges of that image. In these equations, the sign of the encoded side signal describes the phase of the analogue electrical signal, thus implying that the left and right variables are tensors defined by the mid and side vectors. The above equations can be applied to an electronic signal registered from an acoustic domain, and have an inherent psychoacoustic property (how they will be perceived by a listener when they are played back) that is dependent on how the registering microphones are placed geometrically in relation to each other and to the sound field to be captured.

Despite many sound recording and playback techniques being available, there is a general disregard in the art for accurately reproducing the acoustic radiation pattern of an input piece of audio when the audio is generated for consumption by a listener. To date, there has been no solution to how to reproduce the acoustic radiation pattern carried in an input audio signal in an accurate manner.

SUMMARY

The inventors of the present application have realised that, by providing an audio output method and apparatus designed to produce a sound field having a shape that corresponds to that encoded in an input signal, rather than choosing a signalling method and transducer configuration based on other factors, an improved reproduction of the sound field can be achieved.

In accordance with an aspect of the disclosure there is provided a method of producing an acoustic radiation pattern, the method comprising receiving an input audio signal representing a first acoustic radiation pattern, generating an acoustic monopole and an acoustic dipole based on the input audio signal, wherein generating the acoustic monopole and the acoustic dipole is to produce a second acoustic radiation pattern substantially similar to the first acoustic radiation pattern.

Optionally, the input audio signal comprises a first signal component corresponding to a left side of the first acoustic radiation pattern, and a second signal component corresponding to a right side of the first acoustic radiation pattern. Optionally, the first signal component represents a recording of the first acoustic radiation pattern captured by a first recording device, and the second signal component represents a recording of the first acoustic radiation pattern captured by a second recording device. Optionally, the recording captured by the first recording device and the recording captured by the second recording device are captured simultaneously. Optionally, the first and second recording devices are microphones.

Optionally, the method comprises generating the acoustic monopole based on a sum of the first signal component and the second signal component. Optionally, the method comprises generating the acoustic dipole based on a difference between the first signal component and the second signal component.

Optionally, the first acoustic radiation pattern corresponds to a binaural recording. Optionally, the first acoustic radiation pattern corresponds to a Blumlein recording.

Optionally, the method comprises generating the acoustic monopole at a first transducer and generating the acoustic dipole at at least one second transducer. Optionally, the first transducer comprises a woofer or a full-range driver. Optionally, the at least one second transducer comprises a first source and a second source configured to emit acoustic radiation in substantially opposite directions to each other. Optionally, a distance between the first and second sources is approximately half a representative wavelength of the first acoustic radiation pattern. Optionally, a distance between the first and second sources is determined based on a predetermined frequency range. Optionally, the predetermined frequency range is approximately 300 Hz to 6000 Hz.

Optionally, the at least one second transducer comprises a midrange driver configured to generate the acoustic radiation of both the first and second sources. Optionally, the at least one second transducer comprises at least one first midrange driver configured to generate the acoustic radiation of the first source, and at least one second midrange driver configured to generate the acoustic radiation of the second source. Optionally, the at least one second transducer comprises at least one first tweeter configured to generate the acoustic radiation of the first source, and at least one second tweeter configured to generate the acoustic radiation of the second source.

Optionally, generating the acoustic monopole and the acoustic dipole comprises using equalisation to control the ratio of the amplitude of the acoustic monopole to the amplitude of the acoustic dipole. Optionally, the second acoustic radiation pattern is substantially identical to the first acoustic radiation pattern. Optionally, the method further comprises generating the acoustic monopole and the acoustic dipole from sources disposed in the same loudspeaker cabinet. Optionally, the second acoustic radiation pattern is perceivable by a listener at substantially the same volume in any position around the loudspeaker cabinet.

In accordance with another aspect of the disclosure there is provided a loudspeaker device comprising an interface configured to receive an input audio signal representing a first acoustic radiation pattern, a first transducer and at least one second transducer configured to generate an acoustic monopole and an acoustic dipole based on the input audio signal, wherein the first and second transducers are configured to generate the acoustic monopole and the acoustic dipole to produce a second acoustic radiation pattern substantially similar to the first acoustic radiation pattern.

Optionally, the input audio signal comprises a first signal component corresponding to a left side of the first acoustic radiation pattern, and a second signal component corresponding to a right side of the first acoustic radiation pattern. Optionally, the first signal component represents a recording of the first acoustic radiation pattern captured by a first recording device, and the second signal component represents a recording of the first acoustic radiation pattern captured by a second recording device. Optionally, the recording captured by the first recording device and the recording captured by the second recording device are captured simultaneously. Optionally, the first and second recording devices are microphones.

Optionally, the first and second transducers are configured to generate the acoustic monopole based on a sum of the first signal component and the second signal component. Optionally, the first and second transducers are configured to generate the acoustic dipole based on a difference between the first signal component and the second signal component.

Optionally, the first acoustic radiation pattern corresponds to a binaural recording. Optionally, the first acoustic radiation pattern corresponds to a Blumlein recording.

Optionally, the first transducer is configured to generate the acoustic monopole and the at least one second transducer is configured to generate the acoustic dipole. Optionally, the first transducer comprises a woofer or a full-range driver. Optionally, the at least one second transducer comprises a first source and a second source configured to emit acoustic radiation in substantially opposite directions to each other. Optionally, a distance between the first and second sources is approximately half a representative wavelength of the first acoustic radiation pattern. Optionally, a distance between the first and second sources is determined based on a predetermined frequency range. Optionally, the predetermined frequency range is approximately 300 Hz to 6000 Hz.

Optionally, the at least one second transducer comprises a midrange driver configured to generate the acoustic radiation of both the first and second sources. Optionally, the at least one second transducer comprises at least one first midrange driver configured to generate the acoustic radiation of the first source, and at least one second midrange driver configured to generate the acoustic radiation of the second source. Optionally, the at least one second transducer comprises at least one first tweeter configured to generate the acoustic radiation of the first source, and at least one second tweeter configured to generate the acoustic radiation of the second source.

Optionally, the loudspeaker device further comprises a control unit configured to use equalisation to control the ratio of the amplitude of the acoustic monopole to the amplitude of the acoustic dipole. Optionally, the second acoustic radiation pattern is substantially identical to the first acoustic radiation pattern. Optionally, the first and second transducers are disposed in the same loudspeaker cabinet. Optionally, the second acoustic radiation pattern is perceivable by a listener at substantially the same volume in any position around the loudspeaker cabinet.

BRIEF DESCRIPTION OF THE DRAWINGS

Exemplary embodiments of the disclosure shall now be described with reference to the drawings in which.

Throughout the description and the drawings, like reference numerals refer to like parts.

SPECIFIC DESCRIPTION

Figure 1:
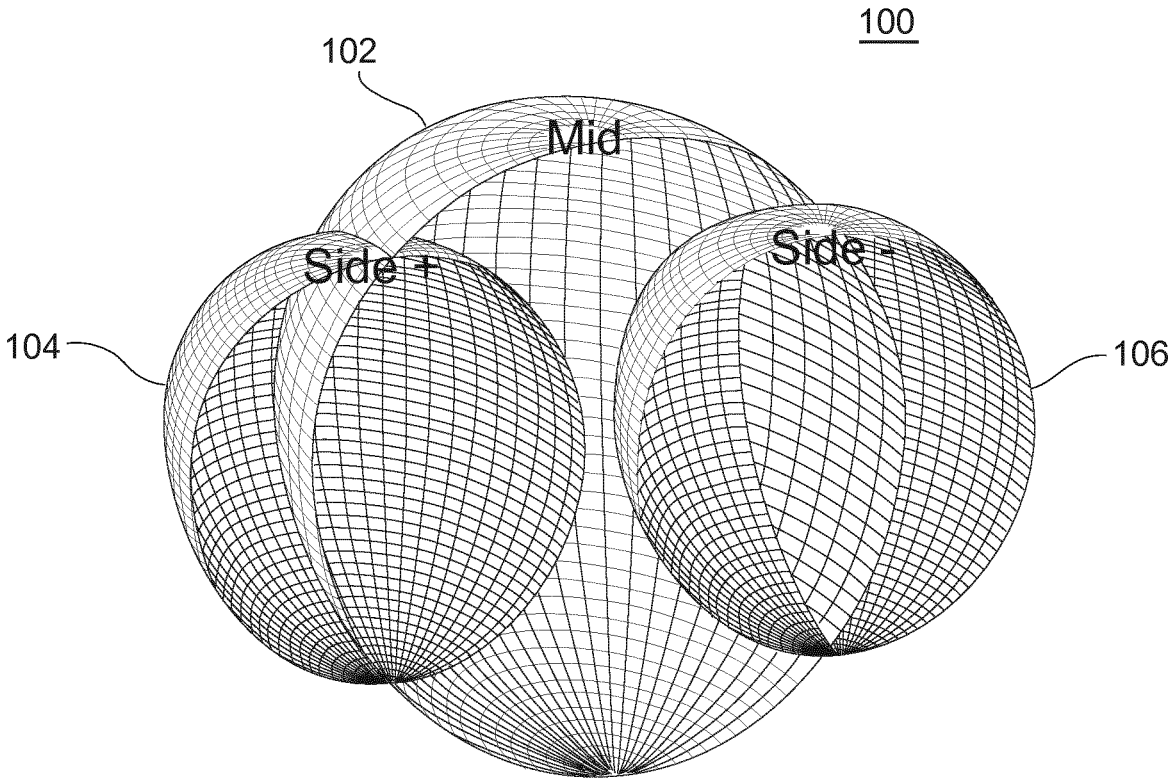
FIG. 1 shows an example acoustic radiation pattern.

As discussed above, the acoustic radiation pattern of an acoustic source can be described in terms of a "mid" and a "side" signal. FIG. 1 shows an example of such an acoustic radiation pattern 100. The acoustic radiation pattern 100 comprises a "mid" portion 102, representing the centre of the acoustic radiation pattern 100. The acoustic radiation pattern 100 also comprises a first side portion 104, representing one edge of the acoustic radiation pattern 100, and a second side portion 106, representing the other edge of the acoustic radiation pattern 100.

The acoustic radiation pattern 100 can be registered in a number of ways. For example, a Blumlein recording, as described in GB394325, may be made. In some embodiments, a binaural recording may be made as known in the art. In other embodiments, other recording techniques may be used which can capture the acoustic radiation pattern 100. For example, a true stereo recording or an artificial stereo recording would also be suitable.

The captured acoustic radiation pattern 100 can be encoded into an electrical signal, using the Blumlein equations described above to provide a left signal and right signal. The resultant electrical signal can be provided to an audio output device for playback to a listener. In the stereophonic standard common in the art, the left signal and right signal are fed respectively into two monopole speakers, providing a stimulus for each ear of the listener.

However, what the inventors of the present application have taken into account is that the mid portion 102 and the side portions 104, 106 of the acoustic radiation pattern 100 represent two orthogonal audio channels that reside in the same air space and which will be processed by the listener using both ears. Recognising this orthogonality allows for a description of the acoustic radiation pattern 100 as two acoustic sources: a monopole representing the mid portion 102 and a dipole representing the side portions 104, 106. An acoustic monopole is an acoustic source that generates sound in all directions from its origin. An acoustic dipole is an acoustic source that generates sound in two opposite hemispheres, in antiphase. It can be imagined as two monopoles acting from the same point but in opposite directions. That the captured acoustic radiation pattern 100 can be represented by a monopole and a dipole has not been appreciated in the art to date. By generating an acoustic monopole and an acoustic dipole to represent the mid portion 102 and side portions 104, 106 respectively, the acoustic radiation pattern 100 can be accurately reproduced for a listener.

Figure 2:
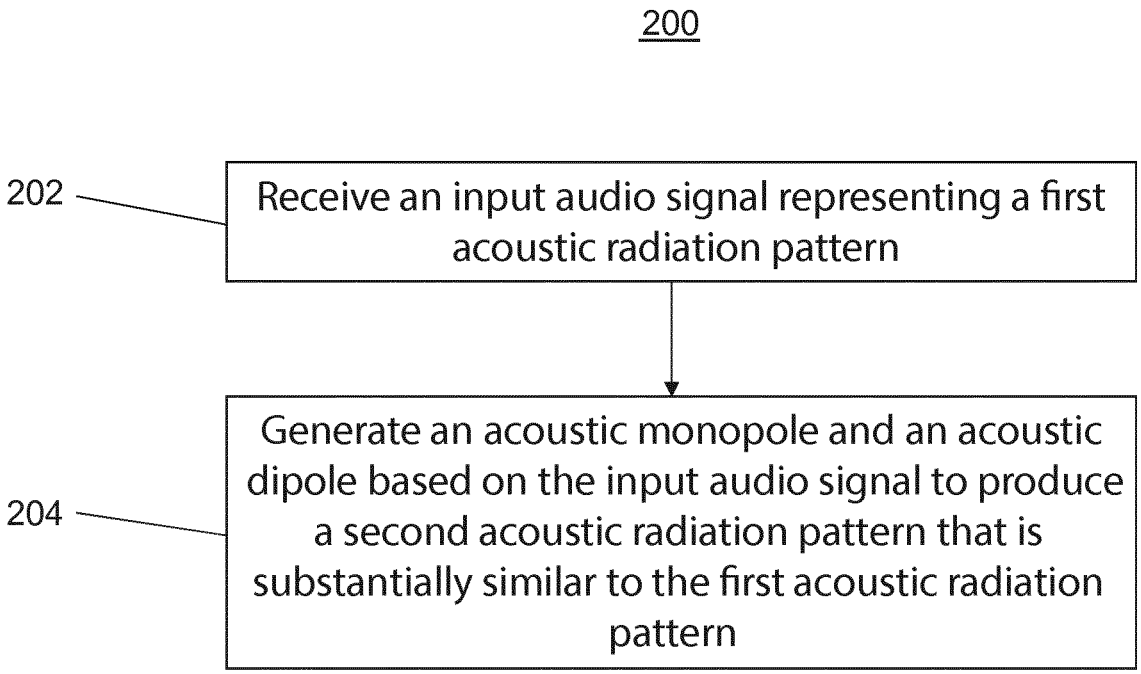
FIG. 2 shows a method of producing an acoustic radiation.

FIG. 2 shows a method 200 of producing an acoustic radiation pattern according to the principles described above. At step 202, an input audio signal representing a first acoustic radiation pattern is received. In the present disclosure, an audio signal may be any signal, such as an electrical signal or wireless non-acoustic signal, which can transformed by an acoustic transducer into acoustic pressure. The audio signal may be received in any suitable manner known in the art. For example, it may be received from a portable or non-portable electronic audio device. Non-limiting examples of such audio devices are hi-fi stereos, smart phones, MP3-players, FM/AM or DAB radios, etc. The audio signal may be received in a wireless manner, for example via Bluetooth, or via a physical means, such as an electrical cable.

At step 204, an acoustic monopole and an acoustic dipole are generated based on the input audio signal. In some embodiments, an input audio signal comprising a left side component and a right side component is converted into a monopole signal and a dipole signal, as will be described in relation to FIG. 3. The acoustic monopole and the acoustic dipole can then be generated based on these signals, with the monopole signal representing the mid portion of the first acoustic radiation pattern and the dipole signal representing the side portion of the first acoustic radiation pattern. In this way, the first acoustic radiation pattern carried by the input audio signal can be reproduced. Indeed, the acoustic monopole and the acoustic dipole are generated with the specific intention of producing a second acoustic radiation pattern that is substantially similar to the first acoustic radiation pattern. This has not been attempted to date in the art. In some embodiments, it is possible to produce a second acoustic radiation pattern that is substantially identical to the first acoustic radiation pattern.

Using the method of FIG. 2, it is possible to reproduce an encoded acoustic radiation pattern in a single speaker unit. It has been found that, aside from an improved stereo image, the produced acoustic radiation may be perceived up to 14 dB louder for sound pressure levels (SPLs) around 50 $dB_{20\ \mu Pa}$ and around 8 dB louder for SPLs around 80 $dB_{20\ \mu Pa}$. Therefore, the method provides an improved reproduction of sound, in particular the complex mid and side portions, encoded in an audio signal.

To provide and optimise the monopole and dipole signals referred to above, signal processing can be applied to the input audio signal before it is passed to the eventual transducers that will produce the sound. A method 300 of performing this signal processing in shown in FIG. 3.

At step 302, the input audio signal is received. This may be done in a substantially similar manner to step 202 in FIG. 2. In this embodiment, the input audio signal comprises two components. The first component corresponds to a left side of the first acoustic radiation pattern and the second component corresponds to a right side of the first acoustic radiation pattern.

The left and right signal components can be generated in a number of ways. In one embodiment, the left side component represents a recording of the first acoustic radiation pattern captured by a first recording device and the right side component represents a recording of the first acoustic radiation pattern captured by a second recording device. The first and second recording devices may be microphones which may be spaced apart from each other in a space in which the first acoustic radiation pattern is present. The recording devices may capture the first acoustic radiation pattern simultaneously, such that the first acoustic radiation pattern is captured at two different locations. One example of such a recording is a binaural recording, known in the art. Another example of such a recording pattern is a Blumlein recording, as described in GB394325. In other embodiments, the input signal may represent a computationally generated acoustic radiation pattern, with the left and right side components also generated computationally in any suitable manner known in the art.

It can be shown, using the equations discussed above, that monopole and dipole signals can be generated from the input left and right side signals. As the monopole represents the mid portion 102 of the acoustic radiation pattern 100 and the dipole represents the side portions 104, 106, the following relation can be determined:

$$\text{mid} = \frac{\text{left} + \text{right}}{2}$$

$$\text{side} = \frac{\text{left} - \text{right}}{2}$$

As can be seen, there is a level difference of a factor of 2 between the mid and side signals and the left and right signals. This level difference is only important when considering the absolute level (e.g. when saturation on a digital stream can cause clipping). In this implementation, and since both vector pairs are affected equally on both sides, the overall signalling effect can be written as:

$$\text{mid}=\text{left}+\text{right}$$

$$\text{side}=\text{left}-\text{right}$$

At step 304, an acoustic monopole signal is generated based on a sum of the left side signal component and the right side signal component. This can also be called the mid signal. At step 306, an acoustic dipole signal is generated based on a difference between the left side signal component and the right side signal component. This can also be called the side signal.

At step 308, an acoustic monopole is generated based on the mid signal. At step 310, an acoustic dipole is generated based the side signal. This can be done using transducers, as will be explained in relation to FIGS. 5 to 13. In this way, the second acoustic radiation pattern is produced, as discussed in relation to FIG. 2.

Figure 4:
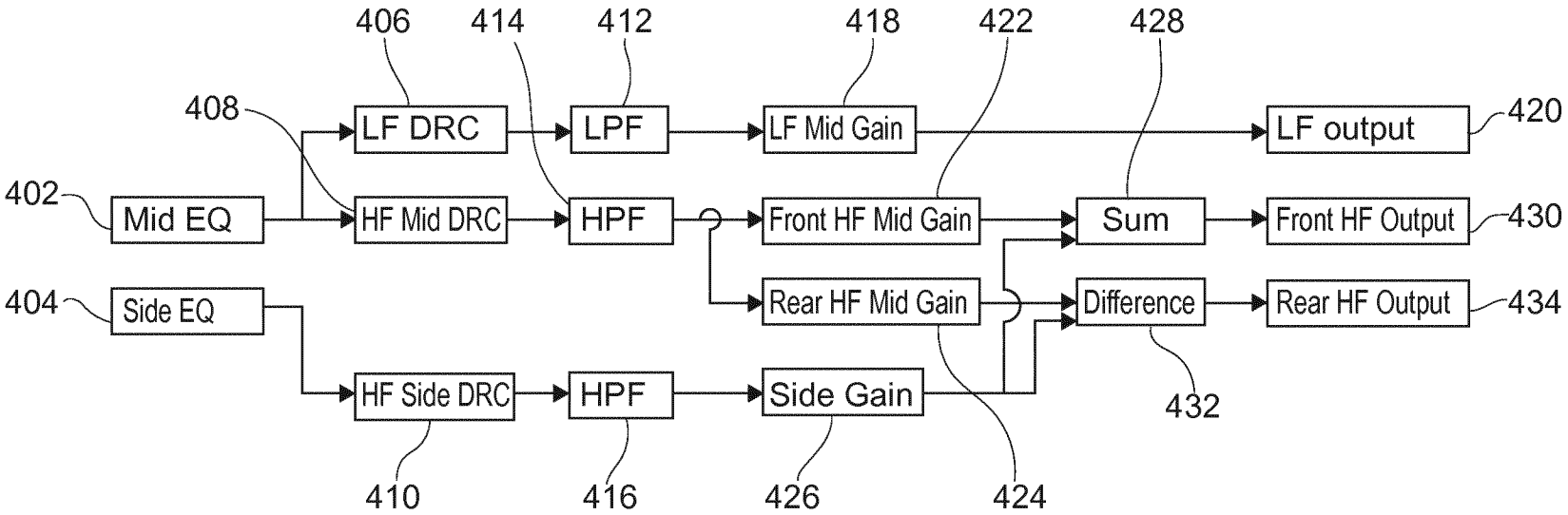
FIG. 4 shows an example of equalisation of a mid signal and a side signal.

To optimise the generated audio, the mid and side signals can be processed. This processing is known as equalisation, and can be used to control the ratio of the amplitude of the mid signal to that of the side signal. The ratio between the mid signal and the side signal may be chosen based on a number of factors, for example the specific cabinet location of the transducers that will carry the signals (i.e. the acoustic configuration of a loudspeaker unit). An example of equalisation is shown in FIG. 4.

The mid signal 402 and the side signal 404 can be subjected to multiband dynamic range compression (DRC), as known in the art. DRC reduces the volume of loud sounds and/or amplifies quiet sounds, thus reducing or compressing an audio signal's dynamic range. In this embodiment, the mid signal is compressed using low frequency DRC 406 and high frequency DRC 408. The side signal is compressed using high frequency DRC 410. In this way, the ratio of the amplitude of the mid signal to that of the side signal can be controlled by adjusting the threshold ratio of input to output for each branch of the signal chain. A further benefit of this is protecting the transducers from high amplitude signals that could potentially be harmful, by setting an upper limit.

The compressed signals can then be passed through digital filters to create a crossover for multi-way transducer systems. In this embodiment, the low frequency compressed mid signal is passed through a low pass filter (LPF) 412, the high frequency compressed mid signal is passed through a high pass filter (HPF) 414 and the high frequency compressed side signal is passed through a HPF 416. This tunes the system to provide the desired SPL/frequency response, and to adjust the cut-off frequency for the side signal before merging it with the mid signal at the output stage.

The compressed and filtered signals can then be used to create appropriate output signals to drive each transducer. FIG. 4 shows the case of an active loudspeaker with one low-frequency woofer and two high-frequency transducers such as full-range woofers or tweeters. In this embodiment, gain 418 is applied to the low-pass filtered mid signal, which can be sent to the woofer as a low frequency output 420. The high-pass filtered mid signal can be split into a front signal 422 and a rear signal 424, to which gain is applied. The front and rear signals 422, 424 control the placement of a monopole speaker in a loudspeaker cabinet. For example, a higher level may be applied to the front signal cabinet design dictates this necessary. Gain 426 is also applied to the to the side signal. The front signal 422 is summed 428 with the side signal 426 to provide a front high frequency output 430. The difference 432 between the rear signal 424 and the side signal 426 is determined to provide a rear high frequency output 434.

In addition to the advantages discussed above, the described equalisation methods allow the overall SPL frequency response of the generated monopole and dipole to be linearized individually. This ensures that the signal integrity of the mid and side signals is respected. For example, if the mid signal does not need the same alterations to its frequency response characteristics as the side signal, they can be treated individually. It will be appreciated that other equalisation methods known in the art could be used, and the processing shown in FIG. 4 is merely one example.

Figure 3:
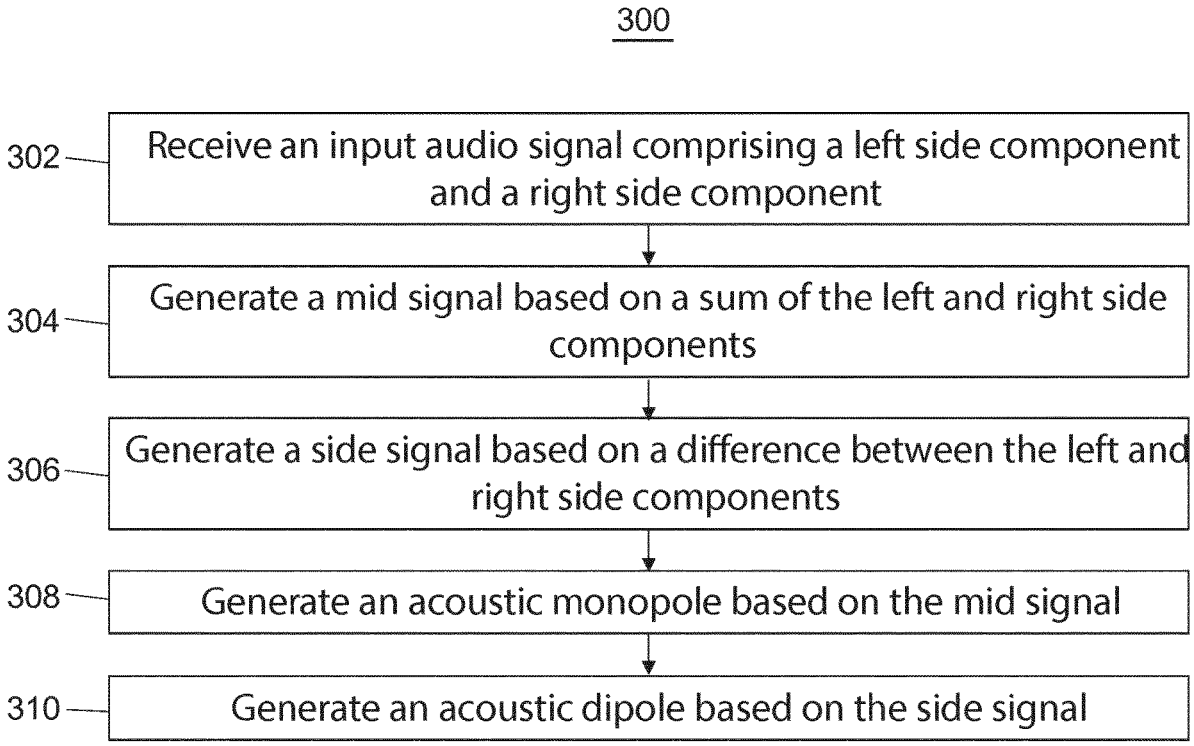
FIG. 3 shows a method of performing signal processing.

The signal processing described in relation to FIGS. 3 and 4 can be performed outside a loudspeaker unit, with the eventual output signals 420, 430 and 434 being fed to the unit in any suitable manner. The output signals can then be sent to transducers that generate the audio monopole and dipole. Alternatively, the signal processing may be performed entirely within a loudspeaker unit. In this case, the input signal, comprising left and right components, is fed to the unit in any suitable manner. It can then be processed, at a control unit, to provide the eventual output signals 420, 430 and 434 which are passed to transducers in the loudspeaker unit. In another alternative, the signal processing may be performed partially externally and partially internally. For example, the left and right signals may be processed into mid and side signals externally to the loudspeaker unit. The mid and side signals may then be fed to the unit in any suitable manner, and processed within the loudspeaker unit, at a control unit, to provide the eventual output signals 420, 430 and 434 for the transducers.

Transducers that can be used in embodiments are those that convert electrical signals into sound, as known in the art. Both monopole speakers, that produce a monopole sound field, and dipole speakers, which produce a dipole sound field, can be used. Examples of such transducers are woofers, sub-woofers, mid-range speakers and tweeters, although any suitable transducer that can convert an input electrical signal into sound can be used. Different transducer configurations can be used to provide the desired monopole-dipole configuration. Some example configurations will be discussed below.

The transducers can be arranged in one or more loudspeaker units, although in the embodiments described in relation to FIGS. 5 to 13, a single loudspeaker unit is employed. That is, all transducers are contained within a single loudspeaker cabinet. To date, a single speaker unit that can accurately reproduce an input acoustic radiation pattern in the manner described herein has not been realised. These loudspeaker units comprise a front baffle, a rear baffle, two side baffles, a top baffle and a bottom baffle), giving the loudspeakers a cuboid shape. It will be appreciated by those skilled in the art that other baffle configurations could be used that enable the appropriate placement of transducers to create the desired acoustic radiation patterns. For example, a cylindrical loudspeaker unit could also be used. Alternatively, a soundbar could be used to provide the desired acoustic radiation pattern.

In some embodiments, the acoustic monopole is generated at a first transducer and the acoustic dipole is generated at a second transducer. In these examples, the first transducer may be a monopole speaker and the second transducer may be a dipole speaker. A monopole speaker is the most common loudspeaker design and can be realized with a one, two or three way system, i.e. frequency range dedicated transducers. A dipole speaker is a single transducer that produces a dipole sound field. A dipole speaker works by creating air movement (as sound pressure waves) directly from the front and back surfaces of the driver, rather than by impedance matching one or both outputs to the air. The front and back surfaces of the driver can be considered as respective sources of acoustic radiation.

Figure 5:
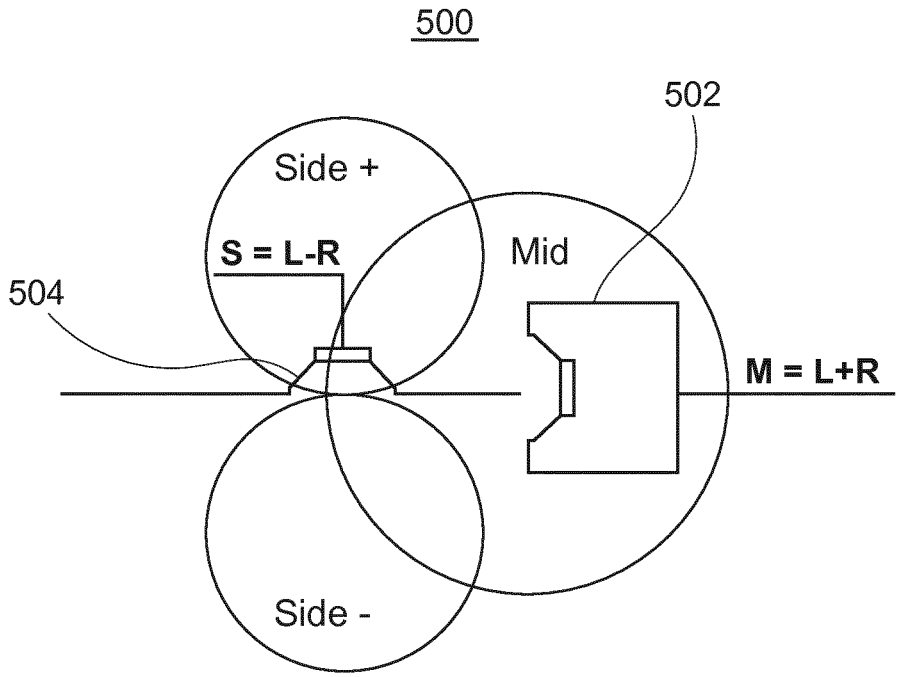
FIG. 5 shows a schematic example of a loudspeaker device having a monopole speaker and a dipole speaker.

FIG. 5 shows schematically an example of a loudspeaker device 500 that comprises a monopole speaker 502 and a dipole speaker 504. In embodiments, the monopole speaker 502 is a woofer. In other embodiments, the monopole speaker 502 is a full-range driver. In embodiments, the dipole speaker 504 may be a midrange driver that can generate acoustic radiation in opposite directions, in order to provide a dipole sound field. It will be envisaged that any other suitable transducers known in the art may be used to provide the monopole speaker 502 and/or the dipole speaker 504. The distance between the centre of monopole and dipole should be as small as possible in order to better reproduce the sound as it was recorded.

Figure 6:
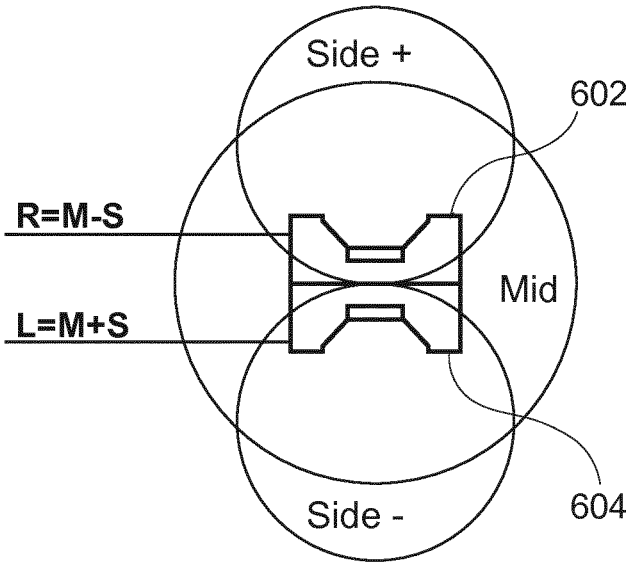
FIG. 6 shows a schematic example of another loudspeaker device having a monopole speaker and a dipole speaker.
Figure 7:
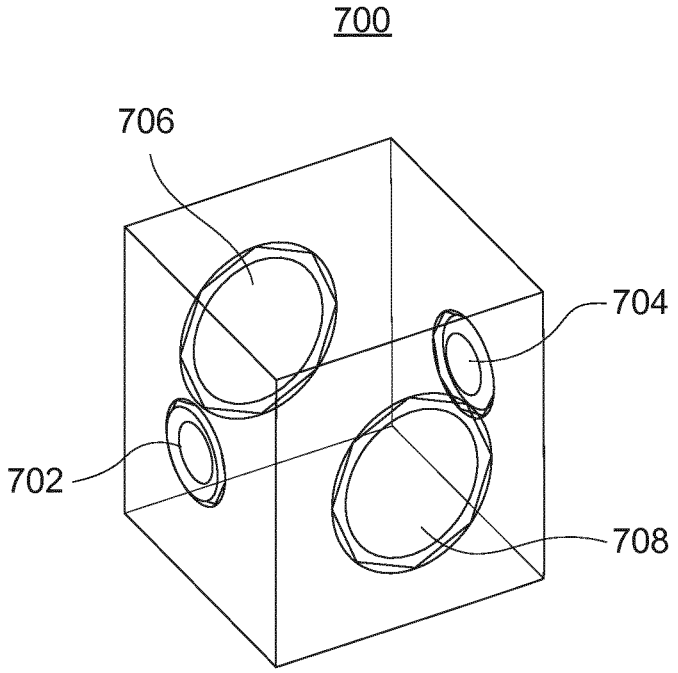
FIG. 7 shows a representational depiction of the loudspeaker device of FIG. 6.

Following Blumlein's simple equations, the transducers shown in FIG. 5 can be rotated 90° within the system and fed the left and right signals instead of the above mid and side signals. This is shown schematically in FIG. 6, where the monopole speaker 602 and the dipole speaker 604 are arranged to face along the same axis. This is shown more representationally in FIG. 7. In the depicted loudspeaker device 700, two full-range speaker drivers 702, 704 are used as the monopole speaker and the dipole speaker. They are mounted opposite to each other and two passive slave membranes 706, 708 are used for low frequency extension of the generated monopole. In some embodiments, the passive slave membranes 706, 708 are used only for the monopole The configurations of FIGS. 5 to 7 represent a simple design, where only two transducers, a monopole speaker and a dipole speaker, are required to produce the desired acoustic radiation pattern. Alternatively, a monopole speaker could be used in place of the dipole speaker, and the interaction of the two monopoles would provide the required monopole and dipole acoustic radiation pattern 100, following the Blumlein equations described above.

It is known in the art that the cabinet internal distance between the sources of a dipole needs to be considered since, if the distance is too small, the resultant frequencies will result in group delay and a phase difference between the ears of a listener. It will therefore be appreciated by those skilled in the art that it may be preferable for the dipole to be realised as two monopoles, with each monopole respectively providing each side of the dipole. That is, each monopole is a respective source of acoustic radiation in the same way as each side of a dipole speaker.

It is also known in the art that signal cancelation due to phase difference will occur if this distance is too large. Moving left and right monopole speakers closer to each other will improve the dipole signal integrity and implies that both monopoles can be mounted in the same cabinet. Here it is recommended to use an internal partitioning.

In order for a listener to perceive played back audio in an optimal manner, the frequency of that audio should be in the human hearing range. Specifically, a frequency between approximately 300 Hz and 6000 Hz is desired. Knowledge of the frequency allows determination of a representative wavelength of the audio using the following relation, where A is the wavelength of the audio, c is the speed of sound in air, and f is the frequency of the audio:

$$\lambda = \frac{c}{f}$$

Using the wavelength, the distance between the first and second sources of the dipole can be determined. It is known that this distance should be approximately half the representative wavelength of the first acoustic radiation pattern to avoid the two signals cancelling each other due to interference. Therefore, the distance d between the sources of the dipole can be given by the following relation:

$$d = \frac{c}{2f}$$

Using the frequency range given above, a distance range of around 0.02 to 0.3 m between the sources of the dipole can be determined as optimal. This allows the dipole sources to be contained within the same cabinet. Refraction around the cabinet also needs to be considered if the external acoustic path is shorter than required. This refraction is dependent on the baffle edge impedance and the ratio of the signal wavelength to the cabinet dimensions. This typically occurs below frequencies around 3 kHz to 4 kHz for this specific configuration. Above this frequency band, only the direct membrane radiation dispersion needs to be considered.

Some examples of configurations where two monopole speakers are used to provide a dipole sound pattern are shown representationally in FIGS. 8 to 13. In each case, the monopole speaker can be provided by a woofer, a full-range speaker, or any other suitable transducer known in the art. The dipole speaker can be provided by different combinations of speakers, as will be explained. All needed internal volumes for each transducer and vents are not illustrated for clarity and is regarded as basic acoustic knowledge for their design.

Figure 8:
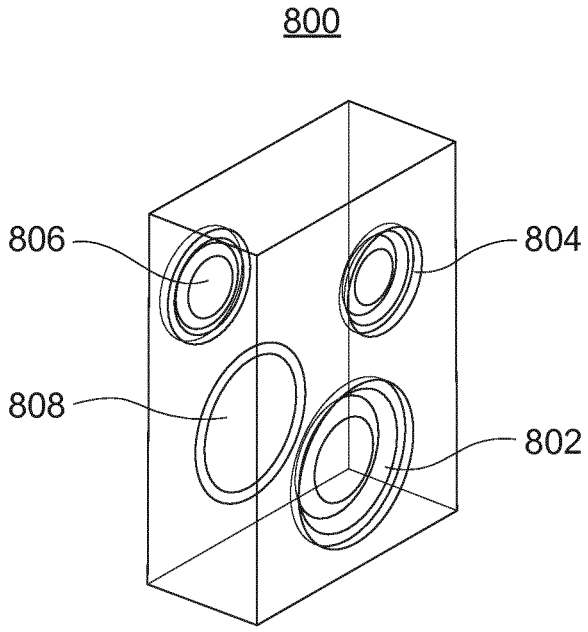
FIG. 8 shows a representational depiction of a loudspeaker device having three monopole speakers.

FIG. 8 shows a loudspeaker device 800 where the monopole is provided by a woofer 802 facing the front of the cabinet. The dipole is provided by a first midrange driver 804 facing the front of the cabinet and a second midrange driver 806 facing the rear of the cabinet. In this configuration, since one of the midrange speakers is facing the front of the cabinet, the midrange speakers 804, 806 will carry both the mid and side signals with an appropriate ratio. The loudspeaker device 800 also comprises a passive slave radiator 808 facing the rear of the cabinet for low frequency extension of the generated monopole.

Figure 9:
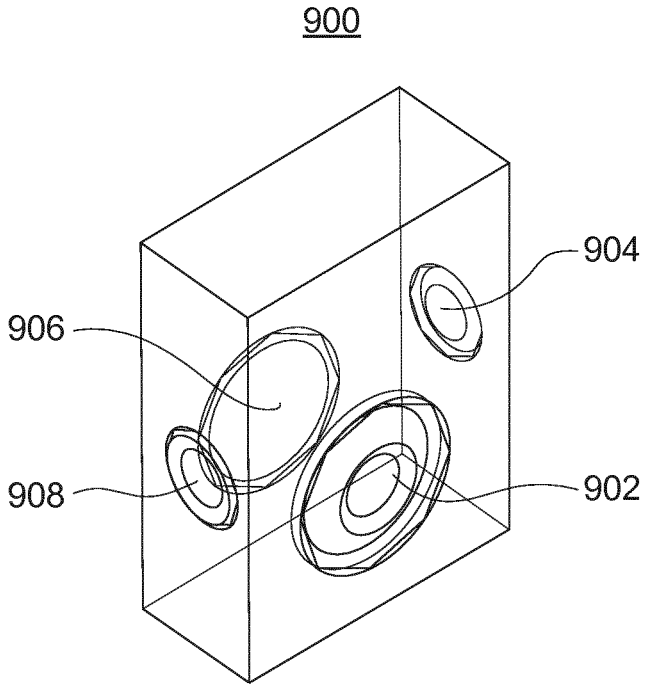
FIG. 9 shows a representational depiction of another loudspeaker device having three monopole speakers.

FIG. 9 shows a loudspeaker device 900 where the monopole is provided by a woofer 902 facing the front of the cabinet. The dipole is provided by a first midrange driver 904 facing one side of the cabinet and a second midrange driver 906 facing the other side of the cabinet. In this configuration, since the midrange speakers 904, 906 are mounted on either side of the cabinet, each membrane of the midrange drivers 904, 906 is mounted perpendicular to the front baffle and so represents a monopole of the generated dipole, i.e., they will be out of phase. Therefore, the midrange speakers 904, 906 will carry only the side signal. The loudspeaker device 900 also comprises a passive slave radiator 908 facing the rear of the cabinet for low frequency extension of the generated monopole. The configuration of the loudspeaker device 900 provides a more simple acoustic design, since the mid and side signals do not need to be mixed, as is the case for the loudspeaker device 800 shown in FIG. 8. This simplifies the required signal processing.

The configurations of FIGS. 8 and 9 are preferably used in a cabinet were the outer dimensions will occupy between one and two litres. The low frequency performance and generated sound pressure level of the monopole can be enhanced by expanding the size of the loudspeaker unit. The difference between FIGS. 8 and 9 is analogous to the difference between FIGS. 5 and 6, where the speakers are rotated relatively by 90°.

Figure 10:
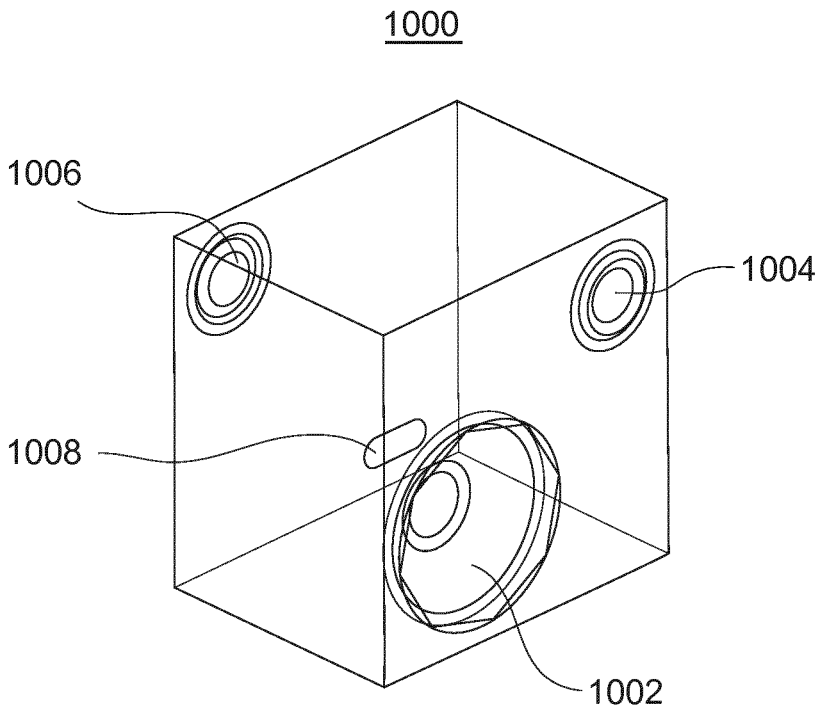
FIG. 10 shows a representational depiction of another loudspeaker device having three monopole speakers.

FIG. 10 shows a loudspeaker device 1000 substantially similar to the loudspeaker device 800 shown in FIG. 8. The loudspeaker device 1000 comprises a woofer 1002 facing the front of the cabinet to provide the monopole. The dipole is provided by a first midrange driver 1004 facing the front of the cabinet and a second midrange driver 1006 facing the rear of the cabinet. The loudspeaker device 1000 has a larger cabinet in order to enhance the low frequency performance and generated sound pressure level of the monopole. For example, the total cabinet capacity of the loudspeaker device 1000 may be around 2 to 5 litres, whereas the total cabinet capacity of the loudspeaker devices 800 and 900 may be around 1 to 2 litres. This configuration provides a higher SPL at low (bass) frequencies, for examples frequencies around 60 Hz.

Figure 11:
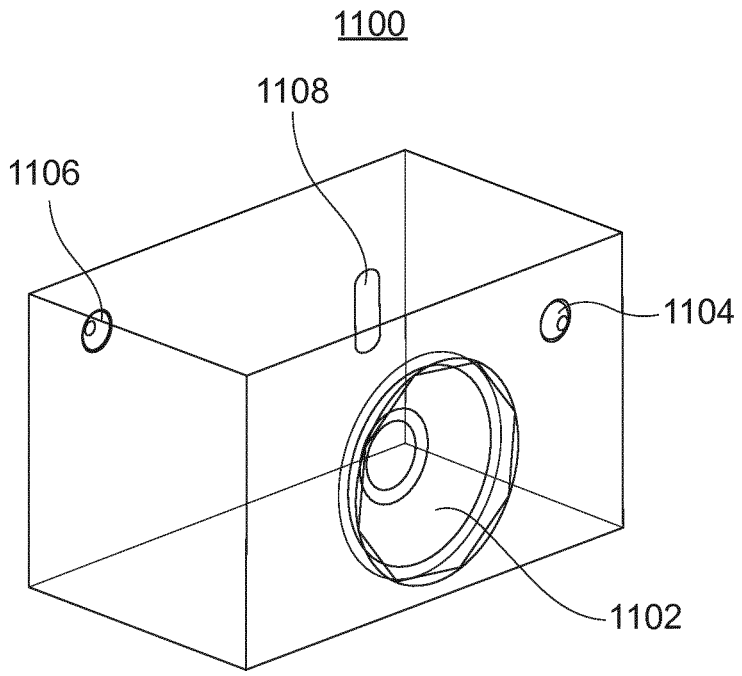
FIG. 11 shows a representational depiction of another loudspeaker device having three monopole speakers.

The loudspeaker device 1000 also comprises a vent 1008 in place of the passive slave radiator 808. A vent has less loss than a passive slave radiator, which gives a more even roll-off. However, a vent displays more noise due to turbulence, especially in smaller cabinets. Therefore, a passive slave radiator may be more suitable for smaller cabinets (typically those having a total cabinet capacity of less than 2 litres), whereas a vent can be used in larger devices FIG. 11 shows a loudspeaker device 1100 similar to the loudspeaker device 1000 shown in FIG. 10. In this case, the monopole is provided by a woofer 1102 facing the front of the cabinet. However, the dipole is provided by a first tweeter 1104 facing the front of the cabinet and a second tweeter 1106 facing the rear of the cabinet. In this configuration, the tweeters 1104, 1106 will also carry the upper frequency band of the mid signal.

Further configurations are possible using a larger cabinet and employing a more traditional three-way speaker driver configuration, where the low, mid and high frequency bands are produced principally by respective speaker drivers. In many cases, the low frequencies are produced by a woofer, the midrange frequencies by a midrange speaker and the high frequencies by a tweeter.

Figure 12:
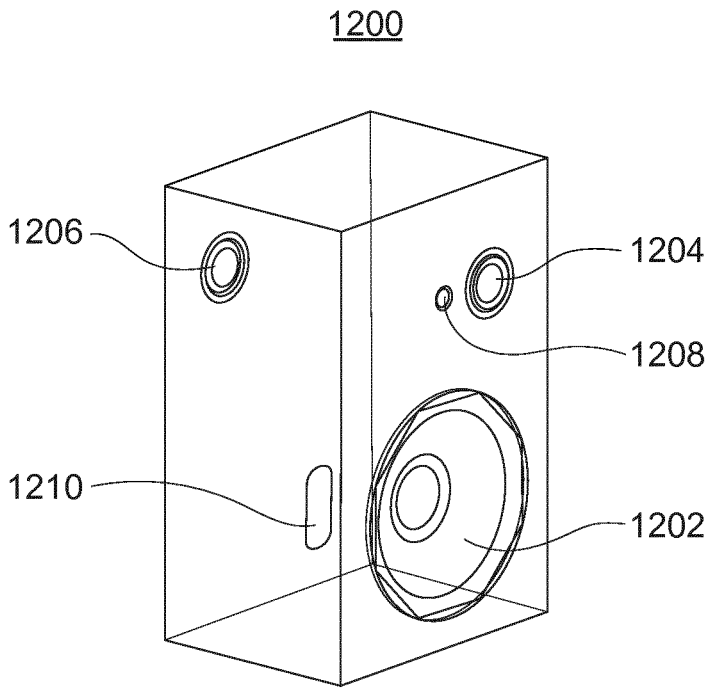
FIG. 12 shows a representational depiction of a loudspeaker device having four monopole speakers.

FIG. 12 shows an example of such a configuration. The loudspeaker unit 1200 comprises a woofer 1202, a front midrange driver 1204, a rear midrange driver 1206, a tweeter 1208 and a vent 1210. The woofer 1202 and tweeter 1208 are used to provide the monopole and the midrange drivers 1204, 1206 are used to provide the dipole. It will be appreciated that the respective drivers can be used to carry parts of the mid and side signal, such that the mid signal is not carried exclusively by the woofer 1202 and tweeter 1208 and the side signal is not carried exclusively by the midrange drivers 1204, 1206.

Figure 13:
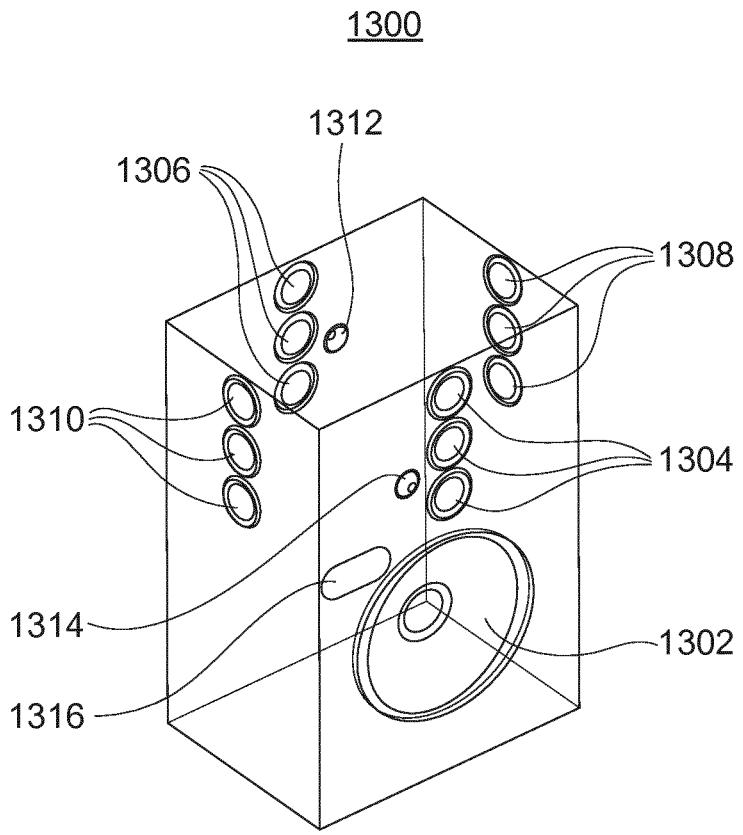
FIG. 13 shows a representational depiction of another loudspeaker device having multiple arrays of monopole speakers.

A further example configuration is shown in FIG. 13, where several midrange drivers are employed in array configurations to reduce vertical reflexes from floor and ceiling. The loudspeaker unit 1300 comprises a woofer 1302, a front midrange driver array 1304, a rear midrange driver array 1306, a first side midrange driver array 1308, a second side midrange driver array 1308, a front tweeter 1312, a rear tweeter 1314 and a vent 1316. Similarly to the configuration of FIG. 12, the woofer 1302 and tweeters 1312, 1314 are principally used to provide the monopole and the midrange drivers 1304, 1306, 1308, and 1310 are used to provide the dipole. The dipole is generated by reproducing the half of the side signal through the midranges mounted on the front-baffle and on one of the adjacent side-baffles, the inverted side signal is then reproduced by the midranges mounted on the rear-baffle and the remaining side-baffle. The configuration of the midrange arrays 1304, 1306, 1308 and 1310 will concentrate the generated dispersion of both the acoustic monopole and dipole to the horizontal plane.

In this configuration, the mid signal can be reproduced only by the transducers mounted on the front baffle or on both sides. Adding a tweeter on the rear baffle is beneficial for the bandwidth of both monopole and di-pole (i.e. more of the bandwidth can be reproduces and hence there is a better reproduction of the mid and side signal). The di-pole orientation can be rotated or configured as a dual di-pole or a symmetric/semi quadrupole. The level ratio between the mid and side signal needs to be adjusted if the midrange and tweeter pair is moved to the walls perpendicular to the front baffle. An advantage of this configuration is that the overall dispersion of sound is improved where the mid and side signal ratio and midrange array phase is entirely dependent of the desired radiation pattern.

In addition to the monopole-dipole reproduction, the configuration of FIG. 13 will allow a variation that is more suited to recreating acoustic radiation patterns captured using Blumlein's microphone recording techniques. This is called a semi-quadrupole radiation pattern, or a "Blumlein pair". This may be achieved by generating two dipoles configured perpendicular to each other. This is realized by front and rear midrange arrays 1304, 1306 carrying the positive side signal and the side midrange arrays 1308, 1310 carrying the negative of the side signal. In this implementation in particular, the cabinet does not need to have a cubic shape, or any other conventional form, which allows further design options to be provided.

In addition to the increase in sound level discussed above, it has been found that the acoustic radiation pattern produced by loudspeaker units disclosed herein is perceivable by a listener at substantially the same volume in any position around the loudspeaker cabinet. This provides an advantage over current systems where the sound has an inherent directional quality, and the listener's perception is compromised depending on their position relative to the loudspeaker unit.

Although particular embodiments have been disclosed in detail, this has been done for purpose of illustration only, and is not intended to be limiting. In particular it is contemplated that various substitutions, alterations and modifications may be made within the scope of the appended claims. Moreover, although specific terms may be employed herein, they are used in a generic and descriptive sense only and not for purposes of limitation. Furthermore, as used herein, the terms "comprise/comprises" or "include/includes" do not exclude the presence of other elements.

What is claimed is:

1. A method of producing an acoustic radiation pattern, the method comprising:

receiving an input audio signal representing a first acoustic radiation pattern having a mid portion and side portions representing two orthogonal audio channels that reside in a same air space; and generating an acoustic monopole that generates sound in all directions at a first transducer and an acoustic dipole that generates sound in two opposite hemispheres in antiphase at at least one second transducer based on the input audio signal, wherein the acoustic monopole represents the mid portion of the first acoustic radiation pattern and the acoustic dipole represents the side portions, wherein the first transducer is adjacent the at least one second transducer, and wherein generating the acoustic monopole and the acoustic dipole produces a second acoustic radiation pattern substantially similar to the first acoustic radiation pattern.

2. The method of claim 1, wherein the input audio signal comprises:

a first signal component corresponding to a left side of the first acoustic radiation pattern; and a second signal component corresponding to a right side of the first acoustic radiation pattern.

3. The method of claim 2, wherein:

the first signal component represents a recording of the first acoustic radiation pattern captured by a first recording device; and the second signal component represents a recording of the first acoustic radiation pattern captured by a second recording device.

4. The method of claim 2, further comprising generating the acoustic monopole based on a sum of the first signal component and the second signal component.

5. The method of claim 2, further comprising generating the acoustic dipole based on a difference between the first signal component and the second signal component.

6. The method of claim 1, wherein the first acoustic radiation pattern corresponds to a binaural recording.

7. The method of claim 1, wherein the first acoustic radiation pattern corresponds to a Blumlein recording.

8. The method of claim 1, wherein the at least one second transducer comprises a first source and a second source configured to emit acoustic radiation in substantially opposite directions to each other.

9. The method of claim 8, where a distance between the first and second sources is approximately half a representative wavelength of the first acoustic radiation pattern.

10. The method of claim 1, wherein generating the acoustic monopole and the acoustic dipole comprises using equalisation to control the ratio of the amplitude of the acoustic monopole to the amplitude of the acoustic dipole.

11. The method of claim 1, wherein the second acoustic radiation pattern is substantially identical to the first acoustic radiation pattern.

12. The method of claim 1, comprising generating the acoustic monopole and the acoustic dipole from sources disposed in a same loudspeaker cabinet.

13. A loudspeaker device comprising:

an interface configured to receive an input audio signal representing a first acoustic radiation pattern having a mid portion and side portions representing two orthogonal audio channels that reside in the same air space;

a first transducer and at least one second transducer configured to generate an acoustic monopole and an acoustic dipole respectively based on the input audio signal, wherein the acoustic monopole generates sound in all directions and the acoustic dipole generates sound in two opposite hemispheres in antiphase, wherein the acoustic monopole represents the mid portion of the first acoustic radiation pattern and the acoustic dipole represents the side portions, wherein the first transducer is adjacent the at least one second transducer, and wherein the first and second transducers are configured to generate the acoustic monopole and the acoustic dipole to produce a second acoustic radiation pattern substantially similar to the first acoustic radiation pattern.

14. The loudspeaker device of claim 13, wherein the input audio signal comprises:

a first signal component corresponding to a left side of the first acoustic radiation pattern; and a second signal component corresponding to a right side of the first acoustic radiation pattern.

15. The loudspeaker device of claim 14, wherein the first signal component represents a recording of the first acoustic radiation pattern captured by a first recording device, and wherein the second signal component represents a recording of the first acoustic radiation pattern captured by a second recording device.

16. The loudspeaker device of claim 14, wherein the first and second transducers are configured to generate the acoustic monopole based on a sum of the first signal component and the second signal component.

17. The loudspeaker device of claim 14, wherein the first and second transducers are configured to generate the acoustic dipole based on a difference between the first signal component and the second signal component.

18. The loudspeaker device of claim 13, wherein the first acoustic radiation pattern corresponds to a binaural recording.

19. The loudspeaker device of claim 13, wherein the first acoustic radiation pattern corresponds to a Blumlein recording.

20. The method of claim 1, wherein a distance between a center of the acoustic monopole and a center of the acoustic dipole is minimized.

* * * * *